US009691559B2

(12) United States Patent
Oh

(10) Patent No.: US 9,691,559 B2
(45) Date of Patent: Jun. 27, 2017

(54) CIRCUIT BREAKER

(71) Applicant: LSIS CO., LTD., Anyang-si, Gyeonggi-do (KR)

(72) Inventor: Ki Hwan Oh, Cheongju-si (KR)

(73) Assignee: LSIS CO., LTD., Anyang-si (KR)

( * ) Notice: Subject to any disclaimer, the term of this patent is extended or adjusted under 35 U.S.C. 154(b) by 119 days.

(21) Appl. No.: 14/524,672

(22) Filed: Oct. 27, 2014

(65) Prior Publication Data

US 2015/0136578 A1 May 21, 2015

(30) Foreign Application Priority Data

Nov. 19, 2013 (KR) ..... 10-2013-0140835

(51) Int. Cl.

| | |
|---|---|
| ***H01H 1/22*** | (2006.01) |
| ***H01H 1/20*** | (2006.01) |
| ***H01H 1/34*** | (2006.01) |
| *H01H 1/18* | (2006.01) |
| *H01H 1/32* | (2006.01) |
| *H01H 73/04* | (2006.01) |

(52) U.S. Cl.

CPC ..... *H01H 1/205* (2013.01); *H01H 1/34* (2013.01); *H01H 1/18* (2013.01); *H01H 1/32* (2013.01); *H01H 73/045* (2013.01)

(58) Field of Classification Search

CPC ..... H01H 77/104; H01H 1/226; H01H 3/3015

USPC ..... 200/244, 400, 243, 248, 274, 401

See application file for complete search history.

(56) References Cited

U.S. PATENT DOCUMENTS

| | | | | |
|---|---|---|---|---|
| 6,326,868 | B1 | 12/2001 | Kranz et al. | |
| 2004/0262137 | A1* | 12/2004 | Bresciani ..... | H01H 77/104 200/244 |
| 2014/0116861 | A1 | 5/2014 | Kim | |

FOREIGN PATENT DOCUMENTS

| | | |
|---|---|---|
| CN | 1596455 | 3/2005 |
| CN | 102024632 | 4/2011 |
| DE | 10-2004-059407 | 6/2006 |
| EP | 0889498 | 1/1999 |
| JP | 2005-310780 | 11/2005 |
| JP | 2013-097905 | 5/2013 |

(Continued)

OTHER PUBLICATIONS

European Patent Office Application Serial No. 14190428.4, Search Report dated Apr. 13, 2015, 8 pages.

(Continued)

*Primary Examiner* — Edwin A. Leon
*Assistant Examiner* — Ahmed Saeed
(74) *Attorney, Agent, or Firm* — Lee Hong Degerman Kang & Waimey

(57) ABSTRACT

A circuit breaker includes: fixed contact points; and a moving contact assembly. The moving contact assembly includes: a shaft; a moving contact that is held in the shaft; and springs that apply torque to the moving contact. The shaft includes: stopping faces that are formed in a direction opposite to the direction in which the moving contact rotates; and guiding faces that are curved from the stopping faces. The moving contact includes: first surfaces that are formed on the radius of rotation of the moving contact; and sliding surfaces that are located at an angle to the first surfaces and slanted toward the center of rotation with respect to the line of action of a tangential force of torque at the points of contact with the guiding faces.

6 Claims, 6 Drawing Sheets

(56) References Cited

FOREIGN PATENT DOCUMENTS

| | | |
|---|---|---|
| WO | 03/041105 | 5/2003 |
| WO | 2012/083829 | 6/2012 |

OTHER PUBLICATIONS

Japan Patent Office Application Serial No. 2014-233747, Office Action dated Oct. 20, 2015, 2 pages.
The State Intellectual Property Office of the People's Republic of China Application Serial No. 201410665086.X, Office Action dated Jun. 21, 2016, 5 pages.
Japan Patent Office Application Serial No. 2014-233747, Notice of Allowance dated Jun. 28, 2016, 3 pages.

* cited by examiner

CIRCUIT BREAKER

CROSS-REFERENCE TO RELATED APPLICATION

Pursuant to 35 U.S.C. §119(a), this application claims the benefit of earlier filing date and right of priority to Korean Application No. 10-2013-0140835, filed on Nov. 19, 2013, the contents of which is incorporated by reference herein in its entirety.

BACKGROUND OF THE INVENTION

1. Field of the Invention

The present invention relates to a circuit breaker, and more particularly, to a circuit breaker including a moving contact assembly which corrects the position of a moving contact depending positional errors of points of contact during the ON operation and return the moving contact to the normal position when the circuit is interrupted.

2. Description of the Conventional Art

In general, a circuit breaker is an electrical device designed to manually open and close an electric circuit using a handle or to protect a load device and a circuit by detecting a fault condition such as short circuit and automatically interrupting the circuit.

FIG. 1 is a cross-sectional view showing a conventional circuit breaker. FIG. 2A is a cross-sectional view showing the internal structure of a moving contact assembly of FIG. 1. FIGS. 2A and 2B will collectively be referred to herein as FIG. 2.

As shown in FIGS. 1 and 2, the conventional circuit breaker includes fixed contact points 10 fixedly mounted within a case C, a moving contact assembly A rotatably mounted to be brought into contact with or separated from the fixed contact points 10, and a switching mechanism 70 that generates driving force to bring the moving contact assembly A into contact with the fixed contact points 10 or separate it from the fixed contact points 10.

The fixed contact points 10 are arranged in a pair symmetrically with respect to the rotation axis of a shaft 20 to be described later.

The moving contact assembly A includes the shaft 20 that is rotatable in a first direction or a second direction opposite to the first direction by means of the switching mechanism 70, a moving contact 30 that is held to be rotatable in the first or second direction, independently from the rotation of the moving contact assembly A by the switching mechanism 70, with respect to the shaft 20, with the rotation axis not fixed to the shaft 20, and springs 50 that apply torque to the moving contact 30 in the first direction with respect to the shaft 20. The first direction is a counterclockwise direction in the drawings, in which the moving contact assembly A is brought into contact with the fixed contact points 10.

The shaft 20 includes stopping walls 24 that stop the rotation of the moving contact 30 in the first direction and guides the moving contact 30 to the normal position. The stopping walls 24 each includes a stopping face 24*a* that is formed in the direction opposite to the first direction in which the moving contact 30 rotates, and a guiding face 24*b* that is curved from the stopping face 24*a*, is shaped like an arc bulging toward the rotation axis of the shaft 20 when viewed from a cross-section perpendicular to the rotation axis of the shaft 20, and faces the rotation axis of the shaft 20. The stopping walls 24 are arranged in a pair symmetrically with respect to the rotation axis of the shaft 20.

The moving contact 30 includes first surfaces 34*a* that are formed along the radius of rotation of the moving contact 30 and come into contact with the stopping faces 24*a*, and sliding surfaces 32*a* that extend in a curve from the first surfaces 34*a* and bring the guiding faces 24*b* into internal contact with them.

The sliding surfaces 32*a* are curved such that the center of curvature of the sliding surfaces 32*a* coincides with the center of curvature of the guiding faces 24*b* when the moving contact 30 is held in the shaft 20.

The first surfaces 34*a* and the sliding surfaces 32*a* are arranged in pairs symmetrically with respect to the rotation axis of the moving contact 30.

With this configuration, when a handle 72 is turned in the counterclockwise direction in the drawings to the ON operation, the moving contact assembly A rotates in the counterclockwise direction in the drawings by means of the switching mechanism 70 and comes into contact with the fixed contact points 10. That is, a circuit connection is established.

On the other hand, if the user manually closes the circuit by turning the handle 72 in the clockwise direction in the drawings, or the circuit is closed when a tripping mechanism 74 of the switching mechanism 70 is actuated due to a failure such as an abnormal current in a line, the moving contact assembly A rotates in the clockwise direction in the drawings by means of the switching mechanism 70 and therefore disconnected from the fixed contact points 10. That is, the circuit is interrupted.

In this procedure, the moving contact 30 receives torque from the springs 50 when disconnected from the fixed contact points 10. Accordingly, the sliding surfaces 32*a* come into contact with the guiding face 24*b*, and a tangential force F of the torque is exerted on the sliding surfaces 32*a* at the points of contact. The component force ($F' \times \cos \theta'$) directed toward the sliding surfaces 32*a* acts as the force for returning the moving contact 30 to the normal position. By this force, the sliding surfaces 32*a* move with respect to the guiding faces 24*b* to allow the moving contact 30 to return to the normal position. The normal position is the position at which the rotation axis of the moving contact 30 coincides with the rotation axis of the shaft 20.

By the way, in the conventional circuit breaker, the sliding surfaces 32*a* are curved to come into internal contact with the guiding faces 24*b*, and this causes the sliding surfaces 32 and the guiding faces 24*b* to be in contact with each other, with the line of action of the force F and the sliding surfaces 32*a* being perpendicular or near perpendicular to each other, while the moving contact 30 has not returned to the normal position. In this case, the component force ($F \times \cos \theta$) directed toward the sliding surfaces 32*a* becomes zero (0) or a lower value than a frictional force, which leads to a lack of the returning force. As a result, a positional error may occur, by which the moving contact 30 cannot return to the normal position, and a contact failure may occur even if the moving contact 30 is released from the off-normal position and put into operation.

SUMMARY OF THE INVENTION

Therefore, the present invention has been made in an effort to provide a circuit breaker which is capable of eliminating positional errors of a moving contact and preventing contact failures between points of contact by increasing the force for returning the moving contact to the normal position.

To achieve these and other advantages and in accordance with the purpose of this specification, as embodied and broadly described herein, there is provided a circuit breaker including a moving contact assembly that is brought into contact with or separated from fixed contact points, the moving contact assembly including: a shaft that is rotatable in a first direction or a second direction opposite to the first direction by means of a switching mechanism; a moving contact that is held to be rotatable in the first or second direction with respect to the shaft, with the rotation axis not fixed to the shaft; and springs that apply torque to the moving contact in the first direction.

The shaft may include: stopping faces that are formed in the direction opposite to the first direction in which the moving contact rotates; and guiding faces that are curved from the stopping faces and face the rotation axis of the shaft.

The moving contact may include: first surfaces that are formed on the radius of rotation of the moving contact and brought into contact with the stopping face; and sliding surfaces that are located at an angle to the first surfaces, face the rotation axis of the moving contact, and are slanted toward the center of rotation with respect to the line of action of a tangential force of torque at the points of contact with the guiding faces.

With this configuration, the position of the moving contact is corrected depending on positional errors of the points of contact when the moving contact comes into contact with the fixed contact points.

Furthermore, when the moving contact is separated from the fixed contact points, the component force of the torque directed toward the sliding surfaces causes the sliding surfaces to move with respect to the guiding faces against the frictional force and returns the moving contact to the normal position where the rotation axis of the moving contact coincides with the rotation axis of the shaft.

The fixed contact points may be arranged in a pair symmetrically with respect to the rotation axis of the shaft.

The stopping faces and the guiding faces may be arranged in pairs symmetrically with respect to the rotation axis of the shaft.

The first surfaces and the sliding surfaces may be arranged in pairs symmetrically with respect to the rotation axis of the moving contact.

Spring supports may be rotatably mounted on parts of the shaft symmetrical with respect to the rotation axis of the shaft.

The springs may be supported on the pair of spring supports so that the pair of spring supports rotate in the direction opposite to the first direction.

The moving contact may include a pair of spring support contact surfaces that are curved from the sliding surfaces, convex in a direction away from the rotation axis of the moving contact, and pressed against the spring supports.

Accordingly, the springs may rotate the pair of spring supports in the direction opposite to the first direction, and the pair of spring supports may press the pair of spring support contact surfaces to rotate the moving contact in the first direction.

The shaft may be symmetrical with respect to the rotation axis of the shaft.

The moving contact may be symmetrical with respect to the rotation axis of the moving contact.

The stopping faces may be formed on the radius of rotation of the shaft.

The guiding faces may be shaped like an arc bulging toward the rotation axis of the shaft when viewed from a cross-section perpendicular to the rotation axis of the shaft.

The first direction may be a direction in which the moving contact assembly is brought into contact with the fixed contact points.

The shaft rotates further than the moving contact in the first direction while the moving contact is in contact with the fixed contact points, the torque of the springs therefore increases, and this increased torque helps increase the contact force between the moving contact and the fixed contact points.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Hereinafter, an exemplary embodiment of the present invention will be described in detail with reference to the accompanying drawings.

Figure 3:
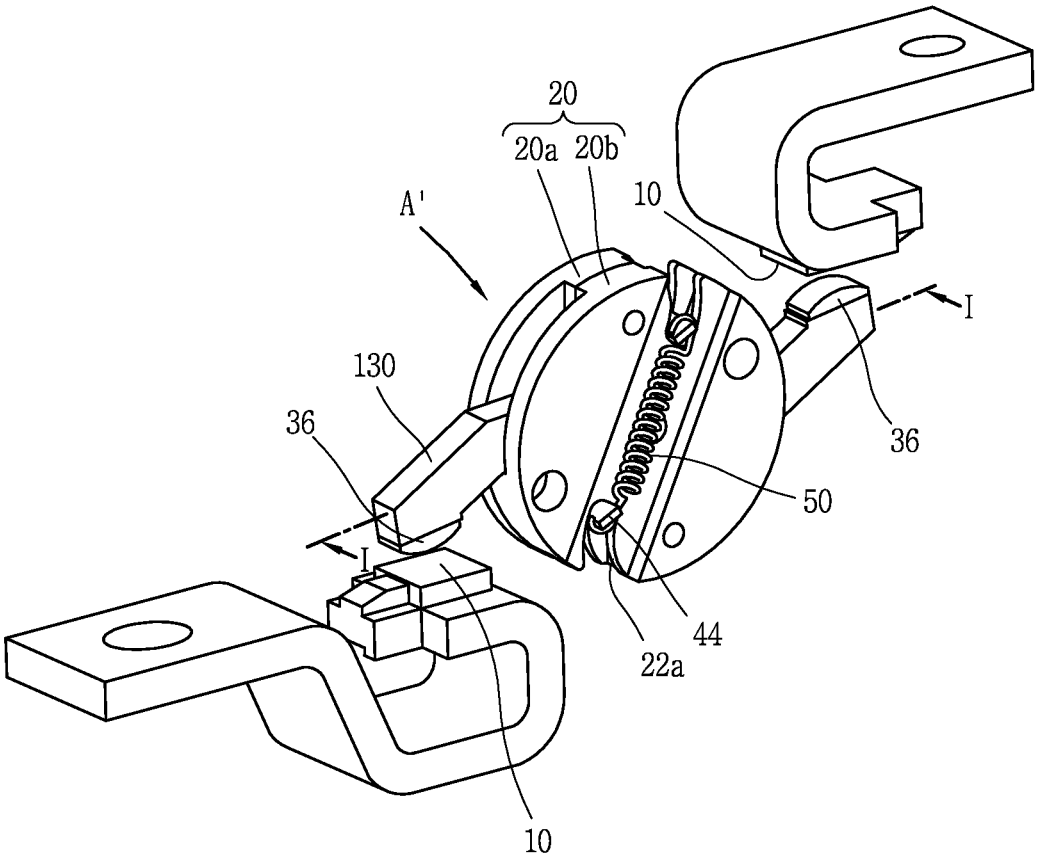
FIG. 3 is a perspective view showing a moving contact assembly according to the present invention.
Figure 4:
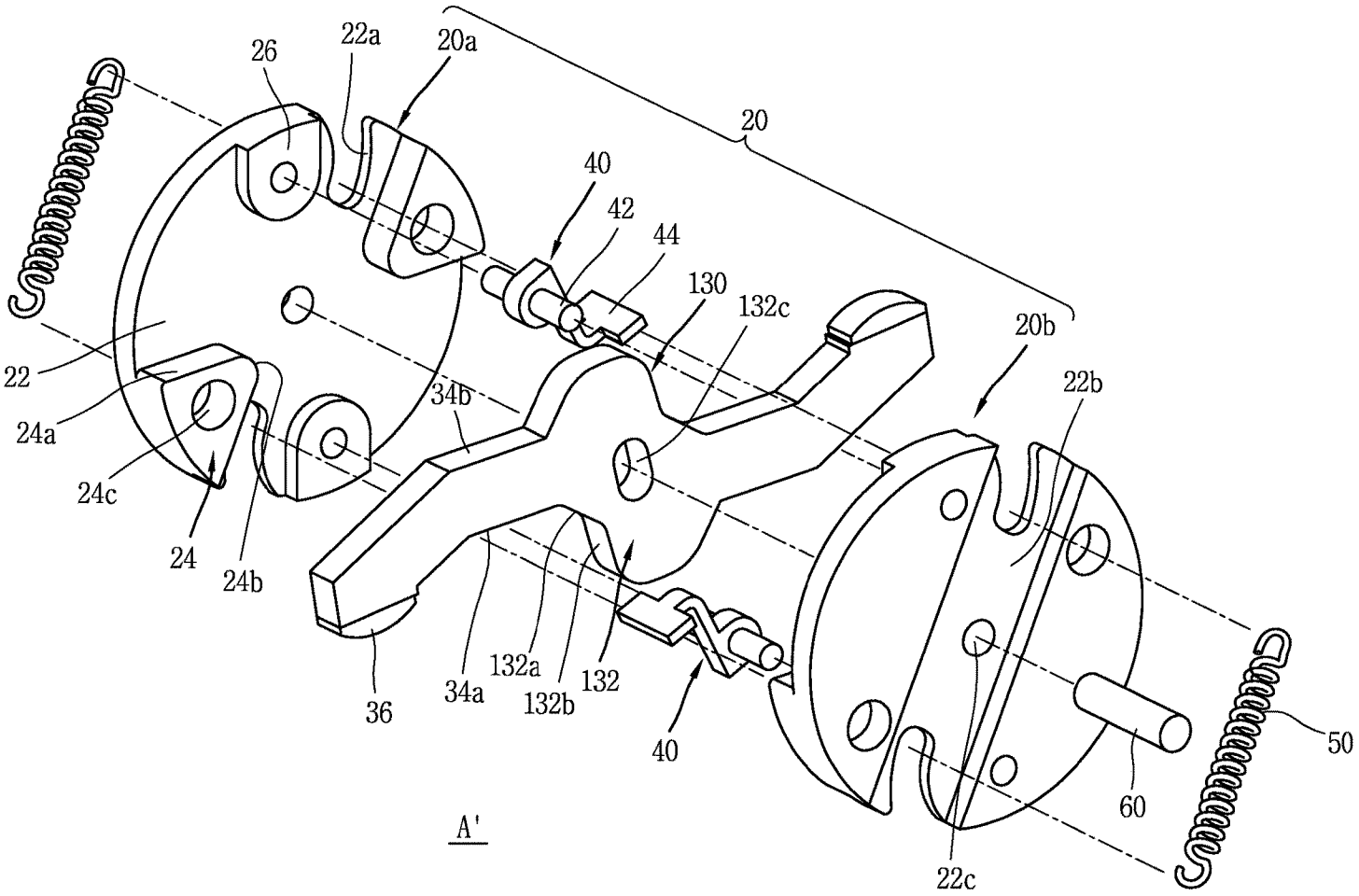
FIG. 4 is an assembly drawing of FIG. 3.
Figure 5:
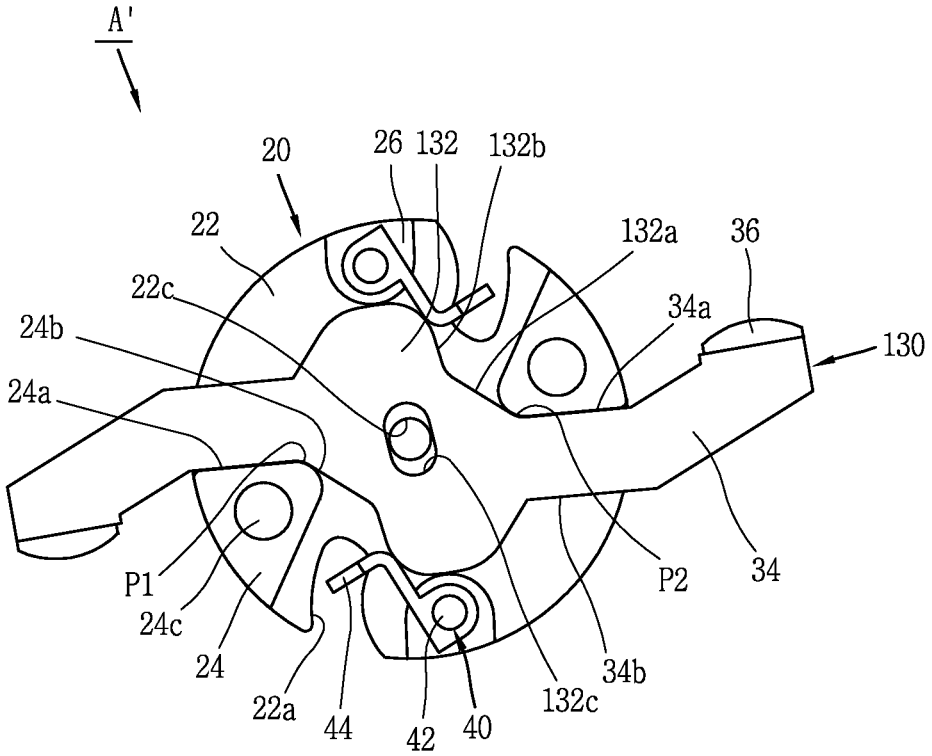
FIG. 5 is a cross-sectional view taken along the line I-I of FIG. 3.
Figure 6A:
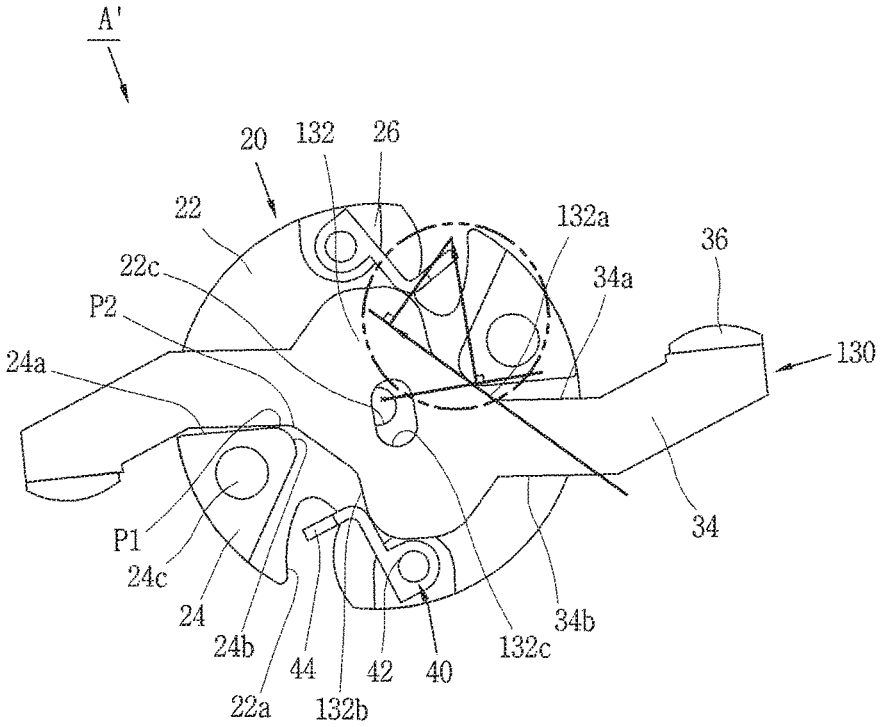
FIG. 6A is a cross-sectional view showing a force exerted to return the moving contact of FIG. 5 from the off-normal position to the normal position and FIG. 6B shows forces exerted on the sliding surfaces of FIG. 6A.
Figure 6B:
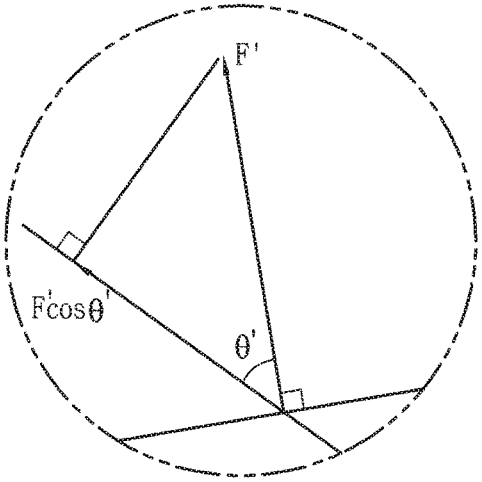

FIG. 3 is a perspective view showing a moving contact assembly according to the present invention. FIG. 4 is an assembly drawing of FIG. 3. FIG. 5 is a cross-sectional view taken along the line I-I of FIG. 3. FIG. 6A is a cross-sectional view showing a force exerted to return the moving contact of FIG. 5 from the off-normal position to the normal position. FIGS. 6A and 6B will collectively be referred to herein as FIG. 6.

As shown in FIGS. 3 to 6, the circuit breaker according to the present invention includes a case C, fixed contact points 10 fixedly mounted within the case C, a moving contact assembly A' rotatably mounted to be brought into contact with or separated from the fixed contact points 10, and a switching mechanism 70 that generates driving force to bring the moving contact assembly A' into contact with the fixed contact points 10 or separate it from the fixed contact points 10.

For better understanding of the drawings, the same or substantially the same parts as the conventional circuit breaker described and illustrated above, such as the case C, the fixed contact points 10, and the switching mechanism 70, are designated by the same reference numerals, and repetitive descriptions of some components will be omitted.

The fixed contact points 10 and the moving contact assembly A' may form a conduction path to receive power from a power supply side and transfer it to a load side by making contact with each other when in the normal position.

Also, the fixed contact points 10 and the moving contact assembly A' may be separated from each other and break the circuit upon the occurrence of an abnormal current such as a fault current.

The fixed contact points 10 may be arranged in a pair symmetrically with respect to the rotation axis of a shaft 20 to be described later, and each of the fixed contact points 10 may be connected to the circuit on the power supply side or the circuit on the load side.

The moving contact assembly A' includes the shaft 20 that is rotatable in a first direction or a second direction opposite to the first direction by means of the switching mechanism 70, a moving contact 130 that is held to be rotatable in the first or second direction, independently from the rotation of the moving contact assembly A' by the switching mechanism 70, with respect to the shaft 20, with the rotation axis not fixed to the shaft 20, and springs 50 that apply torque to the moving contact 130 in the first direction with respect to the shaft 20. The first direction is a counterclockwise direction in the drawings, in which the moving contact assembly A' is brought into contact with the pair of fixed contact points 10. In other words, the first direction is a direction in which the moving contact assembly A' gets closer to the pair of fixed contact points 10.

The shaft 20 may be formed by joining a pair of first and second shaft pieces 20*a* and 20*b* symmetrical to each other together. A space for holding the moving contact 130 may be formed within the shaft 20. In this case, the moving contact 130 may be held in the space in such a way that wing parts 34 to be described later are protruded.

The first shaft piece 20*a* and the second shaft piece 20*b* each may include a circular plate 22, stopping wall 24 radially spaced apart from the center of the circular plate 22 and projecting from the inner side of the circular plate 22, and supporting walls 26 radially spaced apart from the center of the circular plate 22, spaced apart from the stopping walls 24, and projecting from the inner side of the circular plate 22. The inner side of the circular plate 22 refers to the inward side of the shaft 20 when the first shaft piece 20*a* and the second shaft piece 20*b* are joined together.

The stopping walls 24 and the supporting walls 26 may be arranged in pairs symmetrically with respect to the rotation axis of the shaft 20.

The pair of stopping walls 24 may stop the rotation of the moving contact 130 in the first direction, and guide the moving contact 130 to the normal position where the rotation axis of the moving contact 130 coincides with the rotation axis of the shaft 20.

The pair of stopping walls 24 may be formed in the direction opposite to the first direction in which the moving contact 130 rotates.

The stopping walls 24 each may include a stopping face 24*a* formed on the radius of rotation of the shaft 20, and a guiding face 24*b* that is curved from the stopping face 24*a* in the first direction on the side of the rotation axis of the shaft 20 and faces the rotation axis of the shaft 20.

In this case, the stopping face 24*a* may be formed on the radius of rotation of the shaft 20, and the corresponding first surface 34*a* of the moving contact 130 to be described later may be formed on the radius of rotation of the moving contact 130. Otherwise, the stopping face 24*a* may be parallel to the radius of rotation of the shaft 20, and the corresponding first surface 34*a* of the moving contact 130 to be described later may be parallel to the radius of rotation of the moving contact 130.

Moreover, the guiding face 24*b* may be shaped like an arc bulging toward the rotation axis of the shaft 20 when viewed from a cross-section perpendicular to the rotation axis of the shaft 20. Accordingly, the guiding face 24*b* may be come into linear contact with a sliding surface 32*a* of the moving contact 130 to be described later, thereby reducing the frictional force when compared to coming into surface contact with the sliding surface 32*a*. Alternatively, the guiding face 24*b* may be planar.

Each of the stopping walls 24 may have a through-hole 24*c* formed parallel to the rotation axis of the shaft 20.

A shaft driving pin 76 may be inserted into the through-hole 24*c*, and the shaft driving pin 76 may be connected to the switching mechanism 70.

Each of the supporting walls 26 may have a supporting base where a spring support 40 is rotatably mountable, and stop the rotation of the moving contact 130 in the second direction.

The spring supports 40 may be arranged in a pair symmetrically with respect to the rotation axis of the shaft 20. Each of the spring supports 40 may include a rotation center 42 rotatably mounted on the supporting wall 26, and a spring supporting part 44 extending radially from the rotation center 42. The rotation axis of the spring support 40 may be parallel to the rotation axis of the shaft 20.

The circular plate 22 may have a pair of long holes 22*a* and a spring groove 22*b*.

The pair of long holes 22*a* may be symmetrical with respect to the center of the circular plate 22. That is, the pair of long holes 22*a* may be symmetrical with respect to the rotation axis of the shaft 20. As such, the long holes 22*a* may be formed in such a way that one side is opened along the rotational trajectory of the spring supporting part 44 from the outer periphery of the circular plate 22 toward the center.

In this case, the long holes 22*a* may be pierced through the outer and inner surfaces of the circular plate 22. Accordingly, one side of the spring supporting part 44 may pass through the long hole 22*a* from the inner side of the circular plate 22 toward the outer side and protrude outward from the shaft 20.

One end and the other end of the spring 50 may be supported on the spring supporting part 44 protruding outward from the shaft 20.

The spring groove 22*b* may be formed in the outer side of the circular plate 22 so as to keep the circular plate 22 from interfering with the spring 50 supported on the spring support part 44.

The moving contact 130 may be brought into contact with or separated from the pair of fixed contact points 10. The moving contact 130 may include a body 132 including the rotation axis of the moving contact 130, and a pair of wing parts 34 projecting from the body 132 along the radius of rotation of the moving contact 130.

The body 132 may be symmetrical with respect to the rotation axis of the moving contact 130. The body 132 may include a pair of sliding surfaces 132*a* and a pair of spring support contact surfaces 132*b*. The pair of sliding surfaces 132*a* and the pair of spring support contact surfaces 132*b* may be symmetrical with respect to the rotation axis of the moving contact 130.

The sliding surfaces 132*a* can come into contact with the guiding faces 24*b* of the shaft 20, and may be planar. The planar, sliding surfaces 132*a* may be formed as the first surfaces 34*a* to be described later are curved at an angle in the first direction on the side of the rotation axis of the moving contact 130, and the sliding surfaces 132*a* and the rotation axis of the moving contact 130 may face parallel to each other. The sliding surfaces 132*a* may be slanted toward the center of rotation with respect to the line of action of the tangential force F of torque at the points of contact with the guiding faces 24*b*.

The spring support contact surfaces 132*b* may be spaced apart from the rotation axis of the moving contact 130, and curved to be convex toward the spring supporting parts 44. Accordingly, the spring support contact surfaces 132*b* may be brought into contact with and pressed against the spring support parts 44 so that the moving contact 130 rotates in the first direction by the springs 50.

The wing parts 34 may be arranged in a pair symmetrically with respect to the rotation axis of the moving contact 130. Each of the wing parts 34 may include a first surface 34*a* and a second surface 34*b* which is on the side opposite to the first surface 34*a*.

The first surface 34*a* is formed in the first direction with respect to the wing part 34. The first surface 34*a* may be formed on the radius of rotation of the moving contact 130, and brought into contact with the stopping face 24*a*. The first surface 34*a* may be connected at an angle to the sliding surface 132*a* of the body 132 on the side of the rotation axis of the moving contact 130, and may protrude outward from the shaft 20 on the opposite side of the rotation axis of the moving contact 130. A moving contact point 36 may be mounted at the outward-protruding portion of the shaft 20.

In this embodiment, the spring 50 may be a tension spring, and one end and the other end of the spring 50 may be supported on the spring supporting parts 44 of the pair of spring supports 40 to apply torque to the moving contact 130 in the first direction. However, it should be noted that this configuration may be modified in different ways as long as torque can be applied to the moving contact 130 in the first direction. For example, the spring 50 may be a coil spring, one end of which is supported on the shaft 20 and the other end of which is supported on the moving contact 130.

In this embodiment, the pair of fixed contact points 10 may be symmetrical with respect to the rotation axis of the shaft 20, the shaft 20 may be symmetrical with respect to the rotation axis of the shaft 20, and the moving contact 130 may be symmetrical with respect to the rotation axis of the moving contact 130. Alternatively, as long as the stopping faces 24*a* and the guiding faces 24*b* are arranged in pairs symmetrically with respect to the rotation axis of the shaft 20 and the first surfaces 34*a* and the sliding surfaces 132*a* are arranged in pairs symmetrically with respect to the rotation axis of the moving contact 130, the shaft 20 may be asymmetrical with respect to the rotation axis of the shaft 20 and the moving contact 130 may be asymmetrical with respect to the rotation axis of the moving contact 130.

Moreover, the fixed contact points 10, the stopping faces 24*a*, the guiding faces 24*b*, the first surfaces 34*a*, and the sliding surfaces 132*a* may come not in pairs but in multiples. For example, the fixed contact points 10, the stopping faces 24*a*, the guiding faces 24*b*, the first surfaces 34*a*, and the sliding surfaces 132*a* may come in threes equally spaced on the rotation trajectory.

Furthermore, in this embodiment, circular axial holes 22*c* may be respectively formed at the centers of the circular plates of the first and second shaft pieces 20*a* and 20*b*, a longitudinal axial hole 132*c* may be formed at the center where the rotation axis of the moving contact 130 is located, and a pin 60 may pass through the circular axial holes 22*c* and the longitudinal axial hole 132*c*. With these components, the moving contact 130 moves within the range of the longitudinal axial hole 132*c*, and the moving contact 130 is therefore kept from getting off its normal position due to excessive movement. However, they are not the main parts of the present invention and the moving contact assembly A' may be formed without the circular axial holes 22*c* and the longitudinal axial hole 132*c*, so detailed descriptions thereof will be omitted.

Hereinafter, the operational effects of the circuit breaker according to the present invention will be described.

First of all, a procedure of establishing a circuit connection by the circuit breaker of the present invention will be described.

Figure 1:
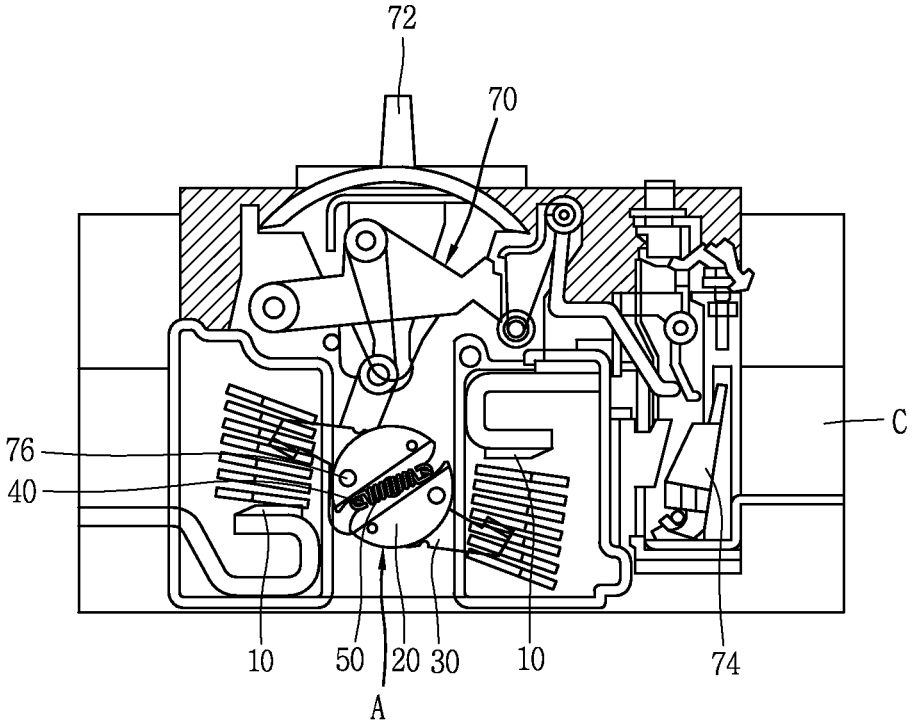
FIG. 1 CONVENTIONAL ART
FIG. 1 is a cross-sectional view showing a conventional circuit breaker.
Figure 2A:
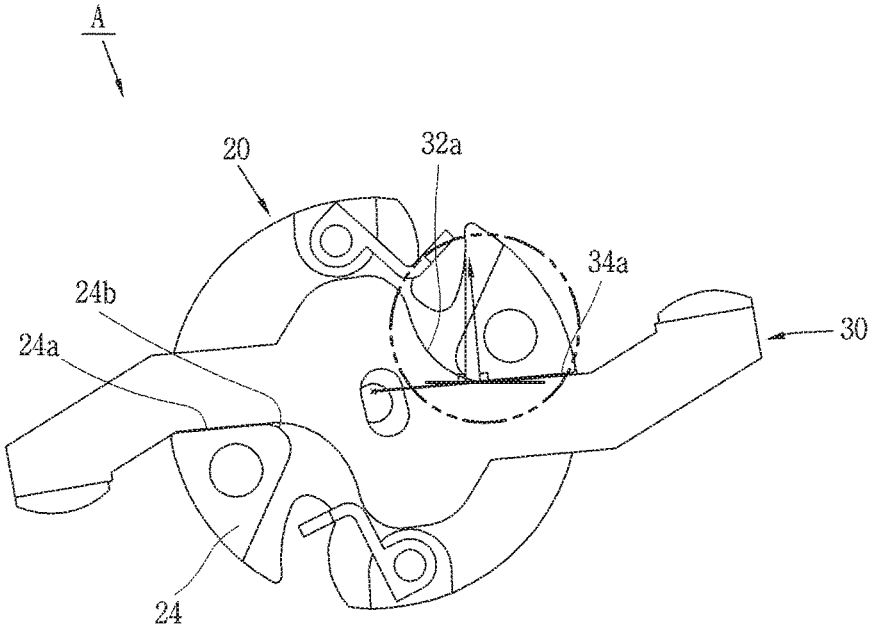
FIG. 2A CONVENTIONAL ART
FIG. 2A is a cross-sectional view showing the internal structure of a moving contact assembly of FIG. 1
Figure 2B:
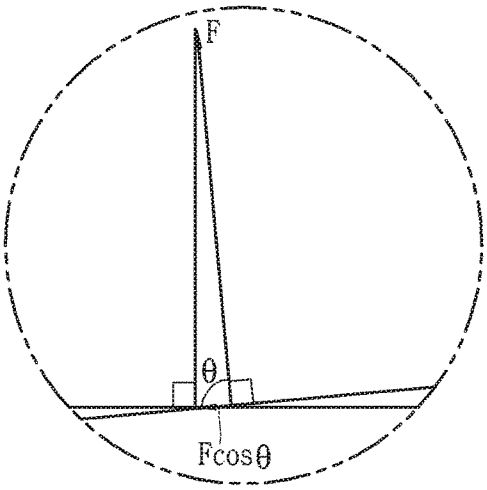
FIG. 2B CONVENTIONAL ART
FIG. 2B shows a component force directed toward sliding surfaces of FIG. 2A.

Referring to FIGS. 1 to 3, in the circuit breaker according to the present invention, the handle 72 of the switching mechanism 70 may be turned in the counterclockwise direction in the drawings to the ON operation. Once the handle 72 is in the ON operation, the moving contact assembly A' may rotate in the first direction (counterclockwise direction in the drawings) by means of the switching mechanism 70 and come into contact with the fixed contact points 10. That is, a circuit connection may be established.

In this procedure, when the pair of moving contact points 36 comes into contact with the pair of fixed contact points, the moving contact assembly A' can correct the position of the moving contact 130 (more precisely, the positions of the pair of moving contact points 36) depending on positional errors or burnout of the points of contact and increase the contact force between the points of contact.

This will be described in more detail below with reference to FIG. 5.

First of all, the spring 50 applies torque so that the pair of spring supports 40 rotates around the rotation center 42 in the same direction as the second direction (clockwise direction in the drawings). As such, the pair of spring supporting parts 44 press the pair of spring support contact surfaces 132*b*, respectively. Accordingly, the moving contact 130 receives torque to rotate around the rotation axis of the moving contact 130 in the first direction (counterclockwise direction in the drawings).

Therefore, if the moving contact 130 has not come into contact with the pair of fixed contact points 10 yet, this means that the moving contact 130 is in the normal position where the rotation axis of the moving contact 130 coincides with the rotation axis of the shaft 20 and the pair of first surfaces 34*a* is in contact with the pair of stopping faces 24*a*.

When the ON operation is operated in this situation, the shaft 20 may rotate in the first direction (counterclockwise direction in the drawings) around the rotation axis of the shaft 20 by means of the pair of shaft driving pins 76 connected to the switching mechanism 70 and the moving contact 130 may rotate together with the shaft 20, supported on the shaft 20, until the moving contact 130 is brought into contact with the pair of fixed contact points 10.

Afterwards, when the moving contact 130 comes into contact with the pair of fixed contact points 10, the moving contact 130 may move on a plane perpendicular to the rotation axis of the shaft 20 depending on positional errors or burnout of the points of contact because the rotation axis of the moving contact 130 is not fixed on the shaft 20. That is, the position of the moving contact 130 may be corrected depending on positional errors or burnout of the points of contact. As a result, the positions of the pair of moving contact points are corrected and therefore brought into stable contact with the pair of fixed contact points 10.

Meanwhile, the moving contact 130 may rotate in the first or second direction, independently from the rotation of the shaft 20. Accordingly, the shaft 20 may rotate further than the moving contact 130 in the first direction (counterclockwise direction in the drawings) even after the moving contact 130 comes into contact with the pair of fixed contact points 10. In contrast, the moving contact 130 may rotate in the second direction (clockwise direction in the drawings) with respect to the shaft 20. Also, the pair of spring supports 40 may rotate in the same direction as the first direction (counterclockwise direction in the drawings) around their rotation centers 42, and the springs 50 may therefore extend lengthwise. Hence, the torque of the springs 50 that forces the moving contact 130 to rotate in the first direction further increases, and this increased torque helps increase the contact force between the pair of moving contact points 36 and the pair of fixed contact points 10.

For reference, the pair of second surfaces 34*b* and the pair of supporting walls 26 may stop the rotation of the moving contact 130 in the second direction to prevent the moving contact 130 from rotating more than a certain amount when the shaft 20 rotates further in the first direction than the moving contact 130 while, in contrast, the moving contact 130 rotates in the second direction with respect to the shat 20.

Next, a procedure of interrupting the circuit by the circuit breaker according to the present invention will be described.

Referring to FIGS. 1 to 3, in the circuit breaker according to the present invention, the user may manually close the circuit by turning the handle 72 of the switching mechanism 70 in the clockwise direction in the drawings, or the circuit may be closed when a tripping mechanism 74 of the switching mechanism 70 is actuated due to a failure such as an abnormal current in a line. Once the circuit is interrupted, the moving contact assembly A' rotates in the second direction (clockwise direction in the drawings) by means of the switching mechanism 70 and the pair of moving contact points 36 is therefore disconnected from the pair of fixed contact points 10. That is, the circuit may be interrupted.

In this procedure, the moving contact assembly A' allows the moving contact 130 to return to the normal position through the pair of sliding surfaces 132*a* and the pair of guiding faces 24*b* after correcting the position of the moving contact 130 depending on positional errors or burnout of the points of contact when the moving contact 130 comes into contact with the pair of fixed contact points 10.

This will be described in more detail below with reference to FIGS. 5 and 6.

First of all, as described above, the moving contact 130 receives torque from the springs 50 to rotate around the rotation axis of the moving contact 130 in the first direction.

While the circuit breaker is in operation, the pair of first surfaces 34*a* is separated from the pair of stopping faces 24*a*. The rotation axis of the moving contact 130 may coincide with the rotation axis of the shaft 20 or not.

In the former case, where the circuit breaker is interrupted while the pair of first surfaces 34*a* is separated from the pair of stopping faces 24*a*, the rotation axis of the moving contact 130 coincides with the rotation axis of the shaft 20, and the circuit breaker is in operation, the shaft 20 may rotate in the second direction around the rotation axis of the shaft 20 by means of the pair of shaft driving pins 76 connected to the switching mechanism 70. As such, as shown in FIG. 5, only the shaft 20 can rotate until the pair of first surfaces 34*a* comes into contact with the pair of stopping faces 24*a* when the moving contact 130 is in the normal position. Once the pair of first surfaces 34*a* comes into contact with the pair of stopping faces 24*a* when the moving contact 130 is in the normal position, the moving contact 130 also can rotate in the second direction, together with the shaft 20, and be separated from the pair of fixed contact points 10.

In the latter case, where the circuit breaker is interrupted while the pair of first surfaces 34*a* is separated from the pair of stopping faces 24*a*, the rotation axis of the moving contact 130 does not coincide with the rotation axis of the shaft 20, and the circuit breaker is in operation, the shaft 20 may likewise rotate in the second direction. Therefore, it can be concluded that the pair of first surfaces 34*a* comes into contact with the pair of stopping faces 24*a* when the moving contact 130 is in the normal position, and the moving contact 130 is separated from the pair of fixed contact points 10 as it rotates in the second direction, together with the shaft 20. The process of returning the moving contact 130 to the normal position will be described below.

That is, if the moving contact 130 is in the off-normal position and the pair of first surfaces 34*a* is separated from the pair of stopping faces 24*a*, the moving contact 130 may receive torque from the springs 50 through the spring supports 40 to bring the pair of sliding surfaces 132*a* into contact with the pair of guiding faces 24*b*. Then, as shown in FIG. 6, the circumferential tangential force F' of the torque may be exerted on the sliding surfaces 132*a* at the points of contact. The component force ($F' \times \cos \theta'$) directed toward the sliding surfaces 132*a* acts as the force for returning the moving contact 130 to the normal position. By this force, the sliding surfaces 132*a* move with respect to the guiding faces 24*b* to allow the moving contact 30 to return to the normal position. The sliding surfaces 132*a* may be a plane slanted toward the center of rotation with respect to the line of action of the tangential force F of torque. Accordingly, the line of action and the sliding surfaces 132*a* may make an acute angle with each other no matter which part of the sliding surfaces 132*a* the guiding faces 24*b* come into contact with. Thus, the component force ($F' \times \cos \theta'$) directed toward the sliding surfaces 132*a* may be greater than zero (0). Although the sliding surfaces 132*a* are located at approximately 40 degrees to the first surfaces 34*a* in order to maximize the component force ($F' \times \cos \theta'$) against the frictional force by taking the friction coefficient of the guiding faces 24*b* into account, they may be located at a different angle to the first surfaces 34*a* as long as this purpose is met.

Referring to FIG. 5, the guiding face 24*b* may be curved from the stopping face 24*a*, and the sliding surface 132*a* may be curved in a plane from the first surface 34*a*. Accordingly, when the moving contact 130 returns to the normal position, the pair of guiding faces 24*b* and curved portions P1 of the stopping faces 24*a* may be placed on the pair of sliding surfaces 132*a* and curved portions P2 of the first surfaces 34*a*. Therefore, the moving contact 120, restored to its normal position, can be kept from moving further.

The circuit breaker according to the present invention may include a moving contact assembly A' that is brought into contact with or separated from the fixed contact points 10 by means of the switching mechanism 70. The moving contact assembly A' may include: the shaft that is rotatable in a first direction or a direction opposite to the first direction by means of the switching mechanism 70; the moving contact 130 that is held to be rotatable in the first or second direction with respect to the shaft 20, with the rotation axis not fixed to the shaft 20; and the springs 50 that apply torque to the moving contact 130 in the first direction. The shaft 20 may include: the stopping faces 24*a* that are formed in the direction opposite to the first direction in which the moving contact 130 rotates; and the guiding faces 24*b* that are curved from the stopping faces 24*a* and face the rotation axis of the shaft 20. The moving contact 130 may include: the first surfaces 34*a* that are formed on the radius of rotation of the moving contact 130 and brought into contact with the stopping face 24*a*; and the sliding surfaces 132*a* that are located at an angle to the first surfaces 34*a*, face the rotation axis of the moving contact 130, and are slanted toward the center of rotation with respect to the line of action of the tangential force F' of torque at the points of contact with the guiding faces 24*b*. In the thus-configured circuit breaker according to the present invention, the position of the moving contact 130 is corrected depending on positional errors of the points of contact when the moving contact 130 comes into contact with the fixed contact points 10. Moreover, the component force (F'×cos θ') directed toward the sliding surfaces 132*a* can be increased by altering the shape of the sliding surfaces 132*a*. Therefore, when the moving contact 130 is separated from the fixed contact points 10, the increased component force (F'×cos θ') causes the sliding surfaces 132*a* to move with respect to the guiding faces 24*b* against the frictional force and return the moving contact 130 to the normal position. As a consequence, positional errors of the moving contact 130 and contact failures between the points of contact can be eliminated.

What is claimed is:

1. A circuit breaker including a moving contact assembly that is brought into contact with or separated from fixed contact points, the moving contact assembly comprising:

a shaft that is rotatable in a first direction or a second direction opposite to the first direction by means of a switching mechanism;

a moving contact that is held to be rotatable in the first or second direction with respect to the shaft, with a rotation axis not fixed to the shaft; and springs that apply torque to the moving contact in the first direction, the shaft comprising:

stopping faces that are formed in a direction opposite to the first direction in which the moving contact rotates; and guiding faces that are curved from the stopping faces and face the rotation axis of the shaft, wherein the stopping faces are formed on a radius of rotation of the shaft, and the guiding faces are shaped like an arc bulging toward the rotation axis of the shaft when viewed from a cross-section perpendicular to the rotation axis of the shaft, the moving contact comprising:

first surfaces that are formed on the radius of rotation of the moving contact and brought into contact with the stopping face; and sliding surfaces that are located at an angle to the first surfaces, face the rotation axis of the moving contact, and are slanted toward a center of rotation with respect toa line of action of a tangential force of torque at a points of contact with the guiding faces, wherein a position of the moving contact is corrected depending on positional errors of the points of contact when the moving contact comes into contact with the fixed contact points, and when the moving contact is separated from the fixed contact points, a component force of the torque directed toward the sliding surfaces causes the sliding surfaces to move with respect to the guiding faces against the frictional force and returns the moving contact to a normal position where the rotation axis of the moving contact coincides with the rotation axis of the shaft.

2. The circuit breaker of claim 1, wherein the fixed contact points are arranged in a pair symmetrically with respect to the rotation axis of the shaft, and the first surfaces and the sliding surfaces are arranged in pairs symmetrically with respect to the rotation axis of the moving contact.

3. The circuit breaker of claim 2, wherein spring supports are rotatably mounted on parts of the shaft symmetrical with respect to the rotation axis of the shaft, the springs are supported on the pair of spring supports so that the pair of spring supports rotate in the direction opposite to the first direction, the moving contact comprises a pair of spring support contact surfaces that are curved from the sliding surfaces, convex in a direction away from the rotation axis of the moving contact, and pressed against the spring supports, and the springs rotate the pair of spring supports in the direction opposite to the first direction, and the pair of spring supports presses the pair of spring support contact surfaces to rotate the moving contact in the first direction.

4. The circuit breaker of claim 2, wherein the shaft is symmetrical with respect to the rotation axis of the shaft.

5. The circuit breaker of claim 2, wherein the moving contact is symmetrical with respect to the rotation axis of the moving contact.

6. The circuit breaker of claim 1, wherein the first direction is a direction in which the moving contact assembly is brought into contact with the fixed contact points, and the shaft rotates further than the moving contact in the first direction while the moving contact is in contact with the fixed contact points, the torque of the springs therefore increases, and this increased torque helps increase the contact force between the moving contact and the fixed contact points.

* * * * *